United States Patent [19]

Brayman

[11] Patent Number: 4,724,897

[45] Date of Patent: Feb. 16, 1988

[54] METHOD OF AND APPARATUS FOR HORIZONTAL CONTINUOUS CASTING

[75] Inventor: Jacob Brayman, Staten Island, N.Y.

[73] Assignee: Press Technology Corporation, White Plains, N.Y.

[21] Appl. No.: 843,299

[22] Filed: Mar. 24, 1986

[51] Int. Cl.[4] ..... B22D 11/04; B22D 11/10

[52] U.S. Cl. ..... 164/485; 164/440; 164/443; 164/490

[58] Field of Search ..... 164/485, 443, 440, 490

[56] References Cited

U.S. PATENT DOCUMENTS

| | | | |
|---|---|---|---|
| 2,371,604 | 3/1945 | Brennan | 164/440 X |
| 2,530,854 | 11/1950 | Brennan | 164/440 |
| 3,363,669 | 1/1968 | Wertli | 164/443 X |
| 3,467,168 | 9/1969 | Charman, Jr. | 164/440 X |
| 3,477,592 | 6/1969 | Wertli | 164/443 |
| 3,519,062 | 7/1970 | Wertli | 164/443 |
| 3,542,119 | 11/1970 | Wertli | 164/443 |
| 3,580,328 | 5/1971 | Eppich et al. | 164/440 X |
| 3,623,536 | 11/1971 | Moritz | 164/485 |
| 3,627,027 | 12/1971 | Adamec et al. | 164/443 X |
| 4,149,580 | 4/1979 | Sardemann et al. | 164/443 X |
| 4,295,516 | 10/1981 | Wilson | 164/485 X |
| 4,463,796 | 8/1984 | Korshunov et al. | 164/485 X |
| 4,580,614 | 4/1986 | Haissig | 164/443 X |

FOREIGN PATENT DOCUMENTS

| | | | |
|---|---|---|---|
| 1812483 | 7/1969 | Fed. Rep. of Germany . | |
| 56-11142 | 2/1981 | Japan | 164/440 |
| 58-187242 | 11/1983 | Japan . | |
| 559074 | 2/1975 | Switzerland . | |

*Primary Examiner*—Gene P. Crosby
*Assistant Examiner*—J. Reed Batten, Jr.
*Attorney, Agent, or Firm*—Ostrolenk, Faber, Gerb & Soffen

[57] ABSTRACT

A method and apparatus which enables a continuous horizontal casting of thin slabs operates on the principle of cooling the molten steel and the cooling mold from the top and bottom while the sides of the cooling mold are comprised of refractory materials which prevent solidification along the short sides of the mold. Consequently, during the initial phases of the solidification process the steel solidifies from the top and the bottom forming sheets of increasing thickness which squeeze and sandwich the molten liquid center. The process avoids formation of voids or other irregularities in the finished metal slabs and it results in a very low rejection rate of finished product. Particularly for application wherein thin metal slabs measuring less than 4 or 5 inches in thickness are produced, the upper side of the mold curves upwardly toward the inlet opening to prevent freezing of the molten metal at the opening.

16 Claims, 6 Drawing Figures

METHOD OF AND APPARATUS FOR HORIZONTAL CONTINUOUS CASTING

BACKGROUND OF THE INVENTION

This invention relates generally to a method and apparatus for continuous casting of thin slabs and more particularly to a continuous casting method and apparatus wherein molten metal flows horizontally as it solidifies into the thin slab.

Conventional continuous casting machines for casting of ferrous and non-ferrous slabs are of the vertical type. Molten steel is introduced at the top of the mold and flows downwardly to the bottom. As the molten steel contacts the relatively much cooler walls of the mold a solid crust or shell forms around a molten interior of the steel, the crust increasing in thickness as the steel travels downwardly. The emergent slab at the bottom of the mold will be a solidified slab of intended shape.

In prior art casting machines the cross section of the cooling mold is constant along the entire length of the mold and the finished product conforms to the shape and cross-section of the initial slab. For relatively thick slabs, for example those exceeding 6 inches in thickness, it is not particularly difficult to initiate and maintain the casting operation. However, the introduction of molten steel into a mold for generating relatively thin slabs, for example 1 to 6 inches in thickness, posses several problems including the tendency of the metal to freeze within the opening and thus stop the casting process. Submerged nozzles do not solve the problem because they still tend to freeze between the mold surface and the nozzle. The problem is aggravated in that all the sides that define the opening of the mold, act as cooling surfaces resulting in the immediate formation of a shell around a molten interior.

Another recurring difficulty with conventional continuous casters is the tendency of the molten interior aggregate to shrink across the thickness toward the cooler outer skin. This condition often results in voids or "pipes" formed at the center of the casting, producing a defective product. Furthermore, all continuous casters of the vertical type have the inherent disadvantages that the machine requires a large overhead clearance and correspondingly large overhead structure to accommodate the vertical path of the solidifying slab. Efforts have been made to reduce the required height by curving the bottom of the mold to follow a partially horizontal path. However, problems remain in that owing to the curved mold, the solidified slab has a curvature that must be straightened. If the slab is somewhat thick, for example 8 inches or thicker, the slab must be reheated, a proposition which is both expensive and complicated.

Still another difficulty with prior art continuous casting cooling molds, arises in that to give the slab a desired shape the interior peripheral walls in the mold are comprised of copper plates which are bolted to supporting outer steel structures which rigidify the copper plates and prevent thermal distortion. Coolant, for example water, is circulated over the outside of the copper plates to keep the copper plates at a relatively low temperature whereby the molten metal within the mold cools and solidifies as previously described. The efficiency of the heat removal and the concurrent formation of the skin or shell for the solidifying slab depends on the intimacy of contact between the molten steel and the interior surface of the copper plates. Further, as the slab emerges from the cooling mold with its interior at least partially molten, the outer skin must have sufficient thickness to prevent break-out of liquid steel as the slab travels through a so-called roller apron section, immediately following the cooling mold. However, as the solidifying skin of the slab is increasingly cooled, it begins to shrink in cross section and tends to separate itself from the inner surface of the copper plates. Consequently, a clearance forms between the slab and the walls of the cooling mold which greatly reduces the heat transfer efficiency in the mold due to the air gap present between the slab and the interior surfaces of the mold. Thus, the slab, at times, emerges from the mold with a shell or skin so thin that break-out of liquid from the interior and damage to the slab is possible.

SUMMARY OF THE INVENTION

Accordingly, it is the object of the present invention to provide an improved method and apparatus for continuous horizontal casting of thin slabs.

It is another object of the present invention to provide a method and apparatus which enables continuous casting of extra thin slabs without freezing at the inlet opening into the cooling mold.

It is still another object of the present invention to provide a method and apparatus for continuous horizontal casting of thin slabs which preventsts formation of voids or "pipes" within the slabs.

It is still a further object of the present invention to provide a method and apparatus for continuous horizontal casting of thin slabs which does not require straightening of the slab product subsequent to its casting.

A further object of the invention is to provide a method and apparatus which assures continuous contact between walls of the cooling mold and the slab being formed.

It is a further object of the present invention to provide a cooling mold which inherently applies at least the minimum required hydrostatic head to the molten metal within the cooling mold.

Overcoming the drawbacks of the prior art and realizing the foregoing and other objectives of the present invention is a horizontally extending continuous casting machine which has a four-sided tubular cooling mold assembly consisting of upper and lower cooling plates and side restraint walls. The upper and lower cooling plates are constructed of materials with high heat transfer such as copper or the like which, in addition, are also water cooled. The side restraint walls are made of refractory material with low heat transfer properties such as urtonia or Jade Pak that are relatively impervious to the flow of molten metal.

An inlet opening of the mold is affixed, in a liquid tight manner, to a tundish or ladle which serves as a reservoir for molten metal, the inlet opening being enlarged relative to the cross section area of the mold near its exit point by curving the upper cooling plate upwardly in an aro so that the mouth or inlet opening is much larger than the exit that shapes and forms the final slab product. Since the inlet end of the mold is significantly larger than the thin exit opening there is no problem of freezing at the entrance and slabs as thin as 1 inch (or thinner) can be reliably fabricated.

Whereas conventional molds cool the molten metal simultaneously from all sides to form a solidifying metallic shell of skin of increasing thickness, the molten steel in the present invention, which travels along the heat refracting side restraint walls, will, at least initially, resist solidification. Thus, the shell consists of a solidifying plate of steel along the top and another solidifying plate along the bottom, both plates sandwiching and squeezing a molten center as they are simultaneously pulled from the mold. Moreover, the narrowing cross-section of the mold has the effect of drawing the two solidifying plates together. All the while the thickness of the plates keeps increasing, forcefully squeezing the steel liquid center. At a given point, depending upon slab thickness, casting rate and the length of the mold, the entire slab is solidified. The metal slabs produced in accordance with the present invention will be free of voids or "pipes", since the conditions promoting such occurrences are absent.

In cases where the slabs are so thick that solidification is not complete at the end of the first primary mold, a secondary mold may be added that abuts the primary mold. In the secondary mold the cooling surfaces would be positioned along the sides, or the short faces, of the slab and the refractory surfaces extend along the top and bottom surfaces. Solidification is now promoted along the short sides where it is needed most, but further along the mold, at a point, where formation of voids is no longer likely.

Because the solidifying upper steel plate is curved towards the upper cooling surface in the primary mold and further because the effort is to pull the solidifying plates proportional to the curvature, it is preferably to carry out the major portion of the bending of the upper plate near the inlet opening where the plate is softer. Accordingly, the upper cooling surface has a parabolic curvature rather than with a constant radius curvature, enabling most of the bending to take place at the beginning of the cycle.

In a further embodiment, and to assure intimacy of contact between the shrinking solidifying shell of prior art casters or the plates of the present invention and the inner surface of the mold, the cooling surfaces of the mold are not fixed in place. Rather, toward the exit opening of the mold where the shrinking is expected, the walls are flexibly mounted to be biased inwardly. Thus, the cooling walls are always in contact with the slab and, further, a required minimum hydrostatic head is automatically applied to the slab. This is particularly useful for forming relatively very thin slabs.

Other features and advantages of the present invention will become apparent from the following description of preferred embodiments of the invention which are presented below in relation to accompanying figures.

BRIEF DESCRIPTION OF THE DRAWINGS

FIG. 1A is cross section along line 1A—1A in FIG. 1.

DETAILED DESCRIPTION OF A PREFERRED EMBODIMENT

Figure 1:
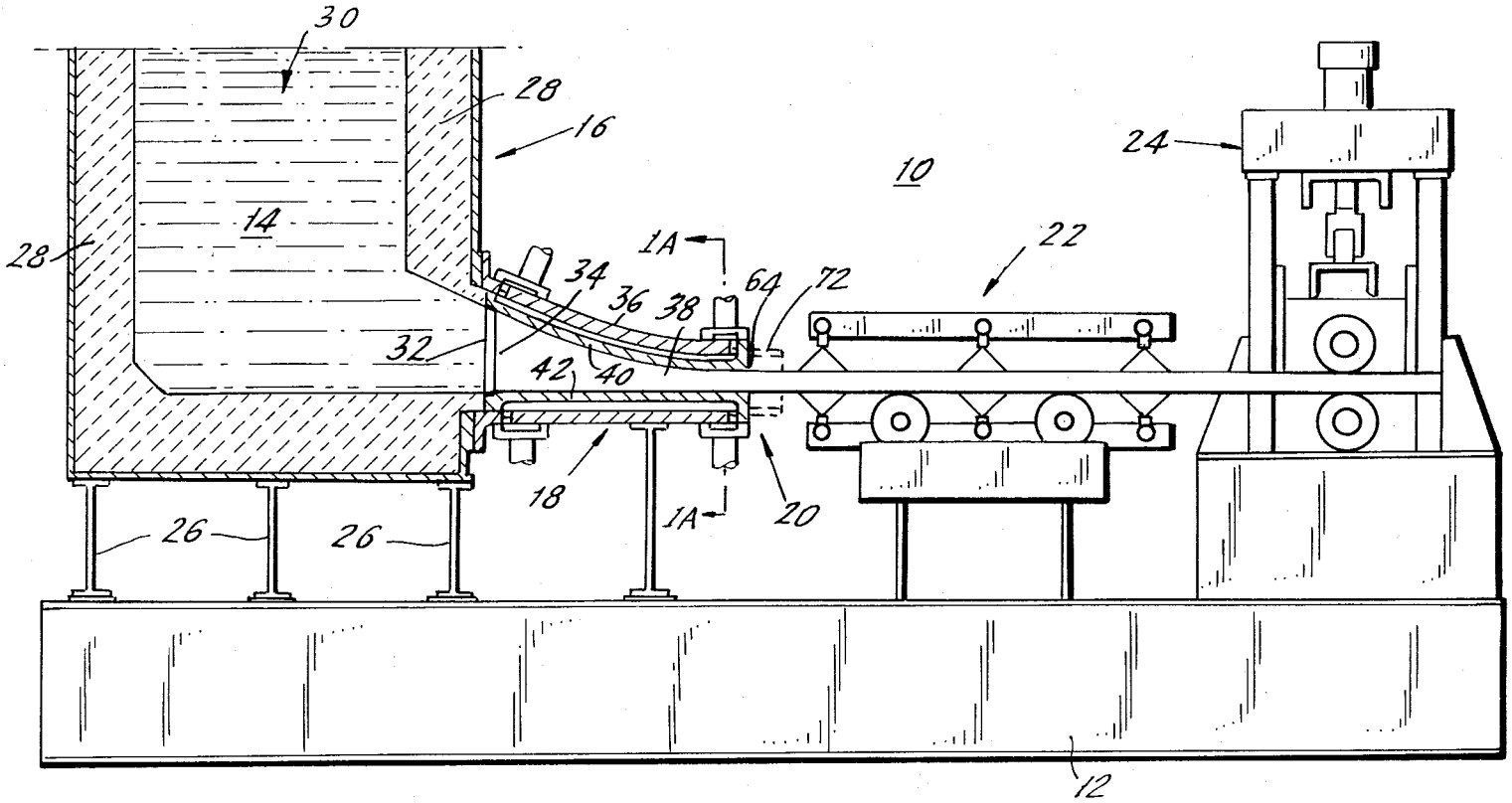
FIG. 1 depicts, in elevational cross-section, a tundish or ladle, a cooling mold in accordance with the present invention, a roller support apron, and withdrawal straightening assemblies which are employed in the various stages of continuous casting.

FIG. 1—The horizontal continuous casting system 10 of the present invention sits on a platform 12 and includes a tundish or ladle 16 which forms a reservoir for molten steel, a primary cooling mold 18 wherein most of the molten steel solidifies, an optional secondary cooling mold 20, a roller support apron 22, and a withdrawal and strengthening assembly 24 employed for straightening the metal slab that emerges from cooling mold 18.

Tundish 16 supported by legs 26 on platform 12 defines an interior reservoir 14 filled with molten steel with well insulated walls 28. Molten steel enters tundish 16 through a top opening 30 and exits at a bottom spout 32 which communicates to an enlarged inlet opening 34 of primary cooling mold 18. Primary cooling mold 18 and tundish 16 are fit tightly to one another.

The present invention focuses on a novel cooling mold construction for casting system 10, which cooling mold exhibits, among others, the following features: Firstly, the cooling mold is horizontally disposed, providing a continuous casting machine of the horizontal type. Secondly, the cross-section of the cooling mold is largest at its inlet opening and narrows towards the exit opening of the mold. Thirdly, the molten material in the mold is cooled primarily from the top and the bottom surfaces in contrast to the prior art wherein the matter is cooled simultaneously and evenly on all sides. In another respect, the cooling mold of the present invention departs from the prior art in that the cooling surfaces of the mold are resiliently mounted in a manner that maintains contact between the walls and the shrinking and solidifying slab in the mold and further such that at least a minimum hydrostatic pressure is applied to the molten matter in the slab under all conditions.

Figure 2A:
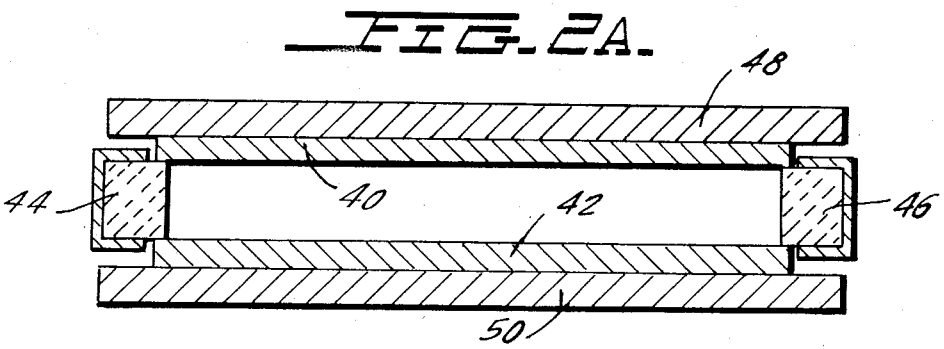
FIG. 2A is a cross-section along line 2A—2A in FIG. 2.
Figure 2B:
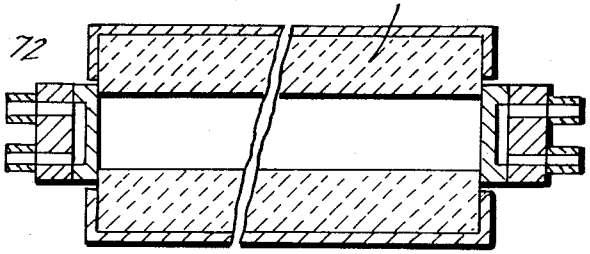
FIG. 2B is a cross-section along line 2B—2B in FIG. 2.

In structure, primary cooling mold 18 comprises a hollow, horizontally disposed and elongated housing 36 which defines an interior 38 surrounded by upper and lower cooling plates 40 and 42 and restraining sidewalls 44 and 46, better illustrated in FIG. 2A. Upper and lower cooling plates 40 and 42 are constructed of copper or similar materials having high heat transfer properties. Cooling plates 40 and 42 are supported, respectively, by upper and lower steel structures 48 and 50 to give them rigidity and to prevent thermal distortion. Cooling channel 52 between lower cooling plate 42 and steel structure 50 provides a path for coolant, such as water, which is circulated through bottom coolant ports 54 and 56. Coolant circulated through upper ports 60 and 62 flows through a second coolant channel 58 to cool upper cooling plate 40.

Sidewalls, 44 and 46 are made of refractory material such as zirconla or Jade Pak that conducts heat poorly and is impervious to the flow of molten metal in the cooling mold.

Dummy bar 88 placed at exit opening 64 of the primary cooling mold 18 helps to initiate the casting process in the conventional matter.

Figure 2:
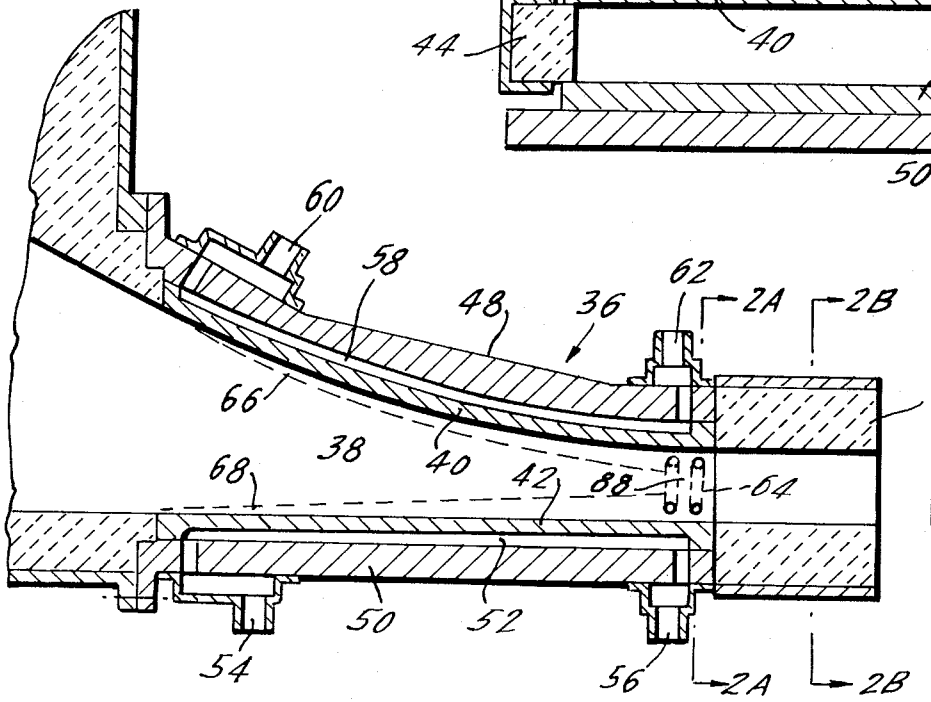
FIG. 2 is an enlargement of the primary cooling section of FIG. 1.
Figure 7A:
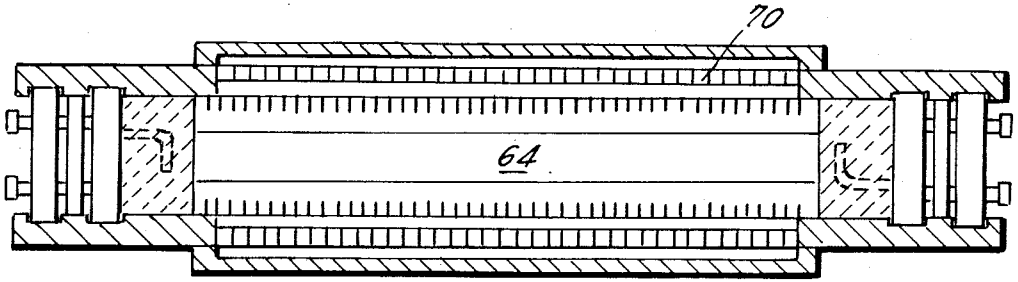

In operation. molten metal in contact with upper and lower cooling plates 40 and 42 begins to solidify to form two moving cursts or sheets of solid matter which continually increase in thickness as exit opening 64 is approached. The two solidifying crusts 66 and 68, shown in dotted lines in FIG. 2, are pulled through primary mold 18 by pinch roll 70, for example as shown in FIG. 1A Optimally, at exit opening 64 the two solidifying sheets will have joined to form a solid slab which emerges from primary cooling mold ready to enter roller support apron 22.

The rate of solidification depends upon slab thickness, casting rate and the length of the mold. For thick slabs, solidification is not complete at the end of primary cooling mold 18 and a secondary cooling mold 72 is installed between primary cooling mold 18 and roller support apron 22. In secondary mold 72, the locations of the side walls are reversed such that the cooling surfaces extend upright along the sides or short faces of the slab while the refractory surfaces extend along the top and the bottom as shown. Now the slab will solidify more rapidly along its short faces where further solidification is needed most.

The advantage of cooling from the top and bottom is that it avoids formation of "pipes" or voids in the center which are the major cause of defective product.

Upper cooling plate 40 curves in an arc so that inlet opening 32 is much larger than the opening at exit 64 which gives the slab its final shape. However. lower cooling plate is flat and both plates are horizontally disposed. The curved plate arrangement overcomes the tendency of metal to freeze at the opening and useful mostly for molds used for casting very thin slabs. Thus, unlike prior art molds in which the metal slab must be thick enough, usually 6 inches and up, to avoid freezing at the opening of the mold, the present invention enables casting of thin slabs measuring as low as 1 inch in thickness or less.

It should be noted that there is no particular limitation on the width of the mold, i.e., the distance between the sides of the slab. Further, because upper solidifying crust 66 curves to upper cooling plate 40, greater pulling force is required to bend crust 66 as it is pulled toward exit opening 64. For this reason, a parabolic curvature is then preferable to a constant radius curvature in upper cooling plate 40 so that most of the bending would then occur at the beginning of the casting process when upper crust 66 is still soft and more pliable.

In prior art vertical molds, the slab which emerges at the bottom of the mold is bent to travel in an arc. As a great residual bending strain always remains in the slab, the slab is processed in several straighteners 24 to remove the residual strain. In contrast, since the mold or molds of the present invention are horizontal, the straightener that is needed could be of much lower capacity than straighteners needed with conventional vertical type machines.

As steel is poured into a mold, the layers of steel in contact with the mold immediately start to solidify. As the solidifying slab is withdrawn the thickening skin or shell around the molten interior is cooling down causing the cross section of the slab to shrink and tending to separate the slab from the inner surfaces of the cooling mold. The clearance that is formed reduces heat transfer between the slab and the mold leaving only a thin solid shell around a molten interior, a slab which is prone to break-out of the liquid steel as the slab is processed in the roller support apron. Efforts to avoid the problem by providing the mold with a slight taper to compensate for the shrinkage of steel have been only marginally successful owing to the fact that heat transfer and shrinkage depend on the rate of slab advance, the solidification of material, and the transition temperature of the material being processed. Thus, no optimal taper design could be found to adequately deal with all processing conditions.

Figure 3:
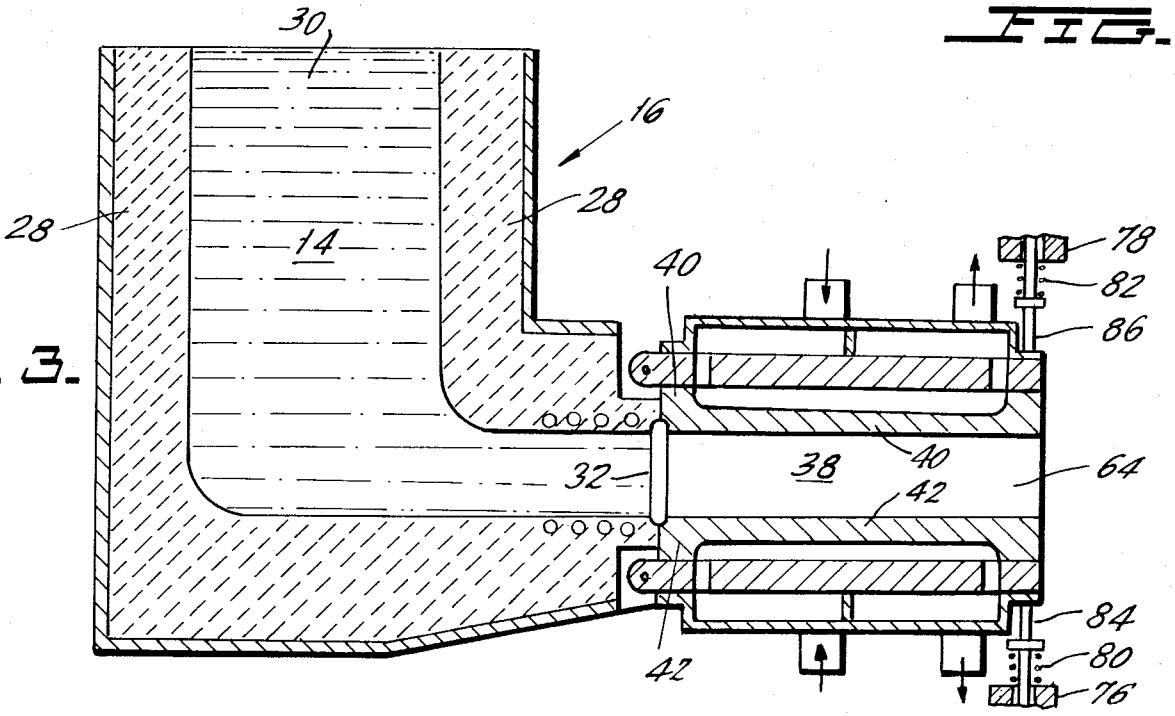
FIG. 3 is an elevational cross-section through a preferred embodiment of a primary cooling mold which is provided with inwardly biased walls to provide contact intimacy between a slab being formed and the interior surfaces of the mold.

The next concept of the present invention solves the problem of loss of contact with the shrinking slab. Although the solution is described in relation to cooling mold 18 previously described, the solution is equally applicable to any other new or conventional mold. In accordance with the invention, upper and lower copper plates 40 and 42 remain fastened to their respective support steel structures, but not entirely in a rigid and unflexible manner. As shown in FIG. 3, plates 40 and 42 make a hinged connection to tundish 16 at near the inlet opening 32 while their other ends, located near exit opening 64, are free to pivot about the hinged connection and are urged inwardly by a variety of means as for example by hydraulic, electrical or mechanical devices or by spring action. The pivoting ends are movable in an amount precisely configured to compensate for the shrinkage gap that would otherwise form between the slab and plates 40 and 42. The amount of inward motion can be readily determined by mechanical feelers or electrical signals and the information thus obtained can be used to position the plates as needed.

The foregoing arrangement is equally applicable to a vertically disposed mold in which all sides will be inwardly biased.

Moreover, it is known that loss of contact with the slab is not entirely due to shrinkage but at times is caused by loss of pressure due to insufficient ferrostatic head, most likely to develop during fabrication of very thin slabs. The adjustable plates of the present invention inherently solve the low ferrostatic problem and maintain the contact pressure needed to form a thick skin around the slab that will prevent the break-out problem. The contact pressure may be varied for different conditions and castings.

Other mounting means for plates 40 and 42 are possible. For example, the plates may be fastened to a backup structure that allows them to pivot at any point in their length. Or they may be arranged so that they can pivot and move radially simultaneously.

In FIG. 3, rigid steel braces 76 and 78 located near exit opening 64 of primary mold 18 contain respective springs 80 and 82 which urge rods 84 and 86 against which cooling plates 42 and 40 to provide the needed intimacy of contact.

Although the present invention has been described in relation to preferred embodiments thereof, many other variations and modifications will now become apparent to those skilled in the art. It is preferred therefore, that the present invention be limited not by the specific embodiment disclosed herein but only by the appended claims.

What is claimed is:

1. A method for producing thin rectangularly shaped metal slabs by continuous casting, said method comprising the following steps:

flowing molten metal through a multi-sided, horizontally disposed cooling.

chamber, said cooling chamber being defined by a top cooling wall and a vertically opposed bottom cooling wall and further by first and second vertically extending side walls, said side walls being assembled with said top and bottom cooling walls, said first and second side walls being comprised of a refractory material which inhibits heat flow and said top and bottom cooling walls being comprised of an efficient heat conducting material, said cooling chamber including an inlet opening and an exit opening, said inlet opening being larger than said exit opening whereby said molten metal does not freeze in the vicinity of said inlet opening;

cooling said vertically opposed cooling walls thereof in a manner which is effective to cause said molten metal in said cooling chamber to solidify from vertically opposed directions to form two substantially disjointed solidifying crusts of metal which eventually join one another to form a metal slab.

2. A continuous casting method as in claim 1 comprising applying a resilient force to said coating walls of said cooling chamber.

3. A continuous casting machine, comprising:

a cooling mold having a cooling chamber disposed for receiving molten metal, said cooling chamber being disposed to enable the molten metal to flow horizontally therethrough, said cooling chamber having an inlet opening for receiving the molten metal and an exit opening, said cooling chamber including a top cooling wall and, vertically opposed thereto, a bottom cooling wall, said cooling walls being vertically spaced from one another by a spacing having a larger predetermined value adjacent said inlet opening, a smaller value adjacent said exit opening and an intermediate spacing, between said inlet opening and said exit opening, which tapers from said larger predetermined value to said smaller value;

first second vertically extending side walls, said side walls being assembled with said top and bottom cooling walls such that said cooling chamber is defined by said top and bottom cooling walls and said first and second side walls, said first and second side walls being comprised of a refractory material which inhibits heat flow and said top and bottom cooling walls being comprised of an efficient heat conducting material; and cooling means for cooling said top and bottom cooling walls in a manner which is effective to cause the molten metal, flowing through said cooling chamber, to solidify gradually from said top and bottom cooling walls toward the interior of said cooling chamber in a manner which is effective for producing two plasticized traveling plates comprised of the molten metal, the plates being separated from one another at least over a portion of their path through said cooling chamber.

4. A continuous casting machine as in claim 3 further comprising means for straightening metal slabs emerging from said exit opening of said cooling mold.

5. A continuous casting machine as in claim 3 further comprising a secondary mold having a respective inlet opening connected to said exit opening of said cooling mold for promoting further solidification of the molten metal, subsequent to the emergence thereof out of said cooling mold.

6. A continuous casting machine as in claim 3 further comprising means for pulling the placticized plates and any remaining molten metal disposed between the plates from the cooling chamber.

7. A continuous casting machine as in claim 3 wherein the vertical spacing between the top and bottom cooling walls at said exit opening is about equal to or less than 1 inch and the distance between the top and bottom cooling walls away from said exit opening is sufficiently large to prevent such solidification of the molten metal, adjacent the inlet opening, which would result in stoppage of the flow of the molten metal through said cooling chamber.

8. A continuous casting machine as in claim 7 wherein said cooling chamber is shaped to produce rectangularly shaped thin metal slabs.

9. A continuous casting machine as in claim 3 further comprising heat removal means for circulating a coolant over said top and bottom cooling walls.

10. A continuous casting machine as in claim 9 wherein said bottom cooling wall is comprised of a generally flat metallic plate and wherein said top cooling wall is comprised of a generally transversely-flat metallic plate which curves upwardly from the exit opening to the inlet opening.

11. A continuous casting machine as in claim 10 wherein said top cooling wall curves substantially parabolically towards said inlet opening.

12. A continuous casting machine as in claim 3 further comprising biasing means for biasing said top and bottom walls toward each other to maintain constant contact between said cooling walls of said cooling chamber and the molten metal as the molten metal shrinks in size while flowing through said mold.

13. A continuous casting machine as in claim 12, wherein said top and bottom cooling walls being pivotally connected in said cooling mold at locations of said cooling walls which lie generally adjacent said inlet opening of said cooling mold and wherein said biasing means comprise means from applying a force directed to said top and bottom cooling walls at locations thereof located downstream from said inlet opening of said cooling mold.

14. A continuous casting machine as in claim 13 wherein said biasing means comprises springs mounted in said cooling mold to urge said top and bottom cooling walls toward one another.

15. A continuous casting machine as in claim 13 wherein the vertical distance between said top and bottom cooling walls at said exit opening is substantially smaller than a corresponding spacing, at said exit opening, between said first and second side walls, whereby said mold produces relatively wide and very thin metal slabs.

16. A continuous casting machine as in claim 15 wherein said cooling chamber is adapted to produce metal slab having a thickness as low as 1 inch or less.

* * * * *